United States Patent [19]

Childs

[11] Patent Number: 4,831,941

[45] Date of Patent: May 23, 1989

[54] WRAP-AROUND HEAT AND SMOKE EXTRACTOR

[75] Inventor: Henry T. Childs, Chattanooga, Tenn.

[73] Assignee: Temperature Adjusters, Inc., Chattanooga, Tenn.

[21] Appl. No.: 76,041

[22] Filed: Jul. 21, 1987

[51] Int. Cl.[4] ..... F23B 7/00

[52] U.S. Cl. ..... 110/317; 110/211; 110/233; 126/69; 126/75; 126/83

[58] Field of Search ..... 110/233, 234, 235, 301, 110/309, 310, 317, 318, 320, 349, 211, 297; 126/83, 990C, 69, 75; 237/51

[56] References Cited

U.S. PATENT DOCUMENTS

| | | | |
|---|---|---|---|
| 54,730 | 5/1866 | Howell | 110/317 |
| 751,650 | 2/1904 | Jewett | 110/297 X |
| 2,556,804 | 6/1951 | Fagan | 126/83 |
| 2,774,317 | 12/1956 | King | 110/317 |
| 4,201,187 | 5/1980 | Skow | 110/297 X |
| 4,206,743 | 6/1980 | Niemela | 110/297 X |
| 4,329,930 | 5/1982 | Riley | 110/310 X |

*Primary Examiner*—Steven E. Warner

[57] ABSTRACT

This invention relates to a method and apparatus for the extraction of heat and smoke from a fuel burn in a firebox. The design is for the firebox exhaust area to be wrapped with its own hot exhaust gases, for smoke extraction, and then, for heat extraction, have all of the outer surface of a stove, fireplace or furnace exposed to said hot exhaust gases. Such a wrap-aroung design burns smoke from said exhaust gases, holds a high temperature in the firebox area, for good combustion, and increases the efficiency of heat extraction by using all of the outer surface of the stove, fireplace or furnace as a high temperature heat exchanger.

8 Claims, 10 Drawing Sheets

40
49
47
45

41
43

48
42

WRAP-AROUND HEAT AND SMOKE EXTRACTOR

BACKGROUND OF THE INVENTION

There is a need to increase the efficiency of capturing more heat produced by the fuel burn in a stove, fireplace, or furnace. Such an increase is always welcome, as it saves fuel and thereby reduces winter heating costs. There is also a need for the reduction of air pollution from the fuel burn exhaust gases as such contributes to the cause of severe damage to health, wild life and vegetation. This invention relates to the improvement of both the heat extraction and the smoke extraction from fuel burn exhaust gases.

SUMMARY OF THE INVENTION

The purpose of this invention is to provide an inexpensive trouble free method of increasing the efficiency of extracting heat with a stove, fireplace or furnace, to improve the performance of said fuel burn, and to drastically reduce the smoke and pollutant materials from the fuel burn exhaust. As the manufacture of wood heaters now comes under Federal Regulation as to emmission limits, this invention contributes greatly to this solution.

Various other features of the method and apparatus of the present invention will become obvious to those skilled in the art upon reading the disclosure set forth hereinafter.

BRIEF DESCRIPTION OF DRAWINGS

Referring now to the drawings, the apparatus is shown installed on a stove, free-standing fireplace, drum stove, incinerator, an attachment for the exhaust of an internal-combustion engine, such as a diesel engine, and as an attachment to a furnace or stove.

DETAILED DESCRIPTION

Figure 1:
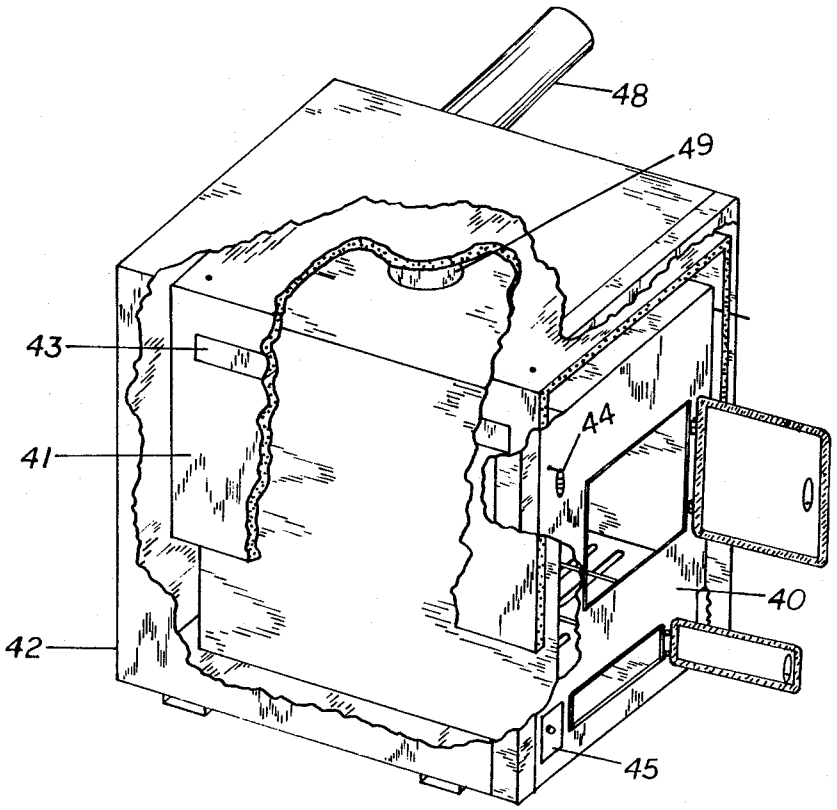
FIG. 1 is a cut-away view of the apparatus installed on a wood or coal stove, showing its wrap-around features of the firebox exhaust area.
Figure 2:
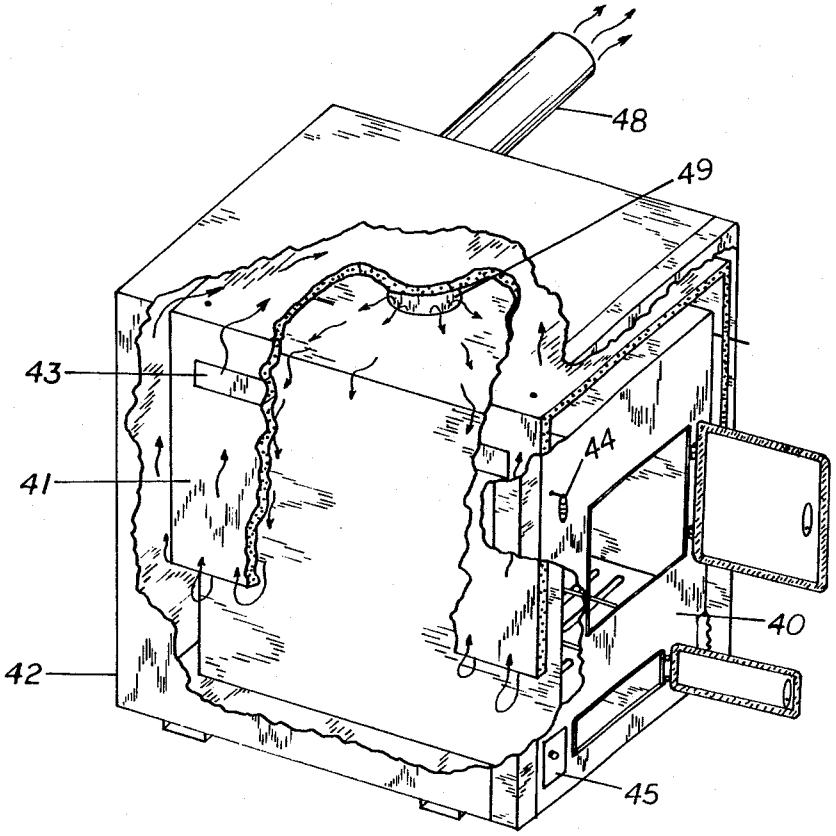
FIG. 2 is a cut-away veiw of the apparatus, as shown in FIG. 1, and having arrows that represent the flow of the exhaust gases.
Figures 3, 4, 5:
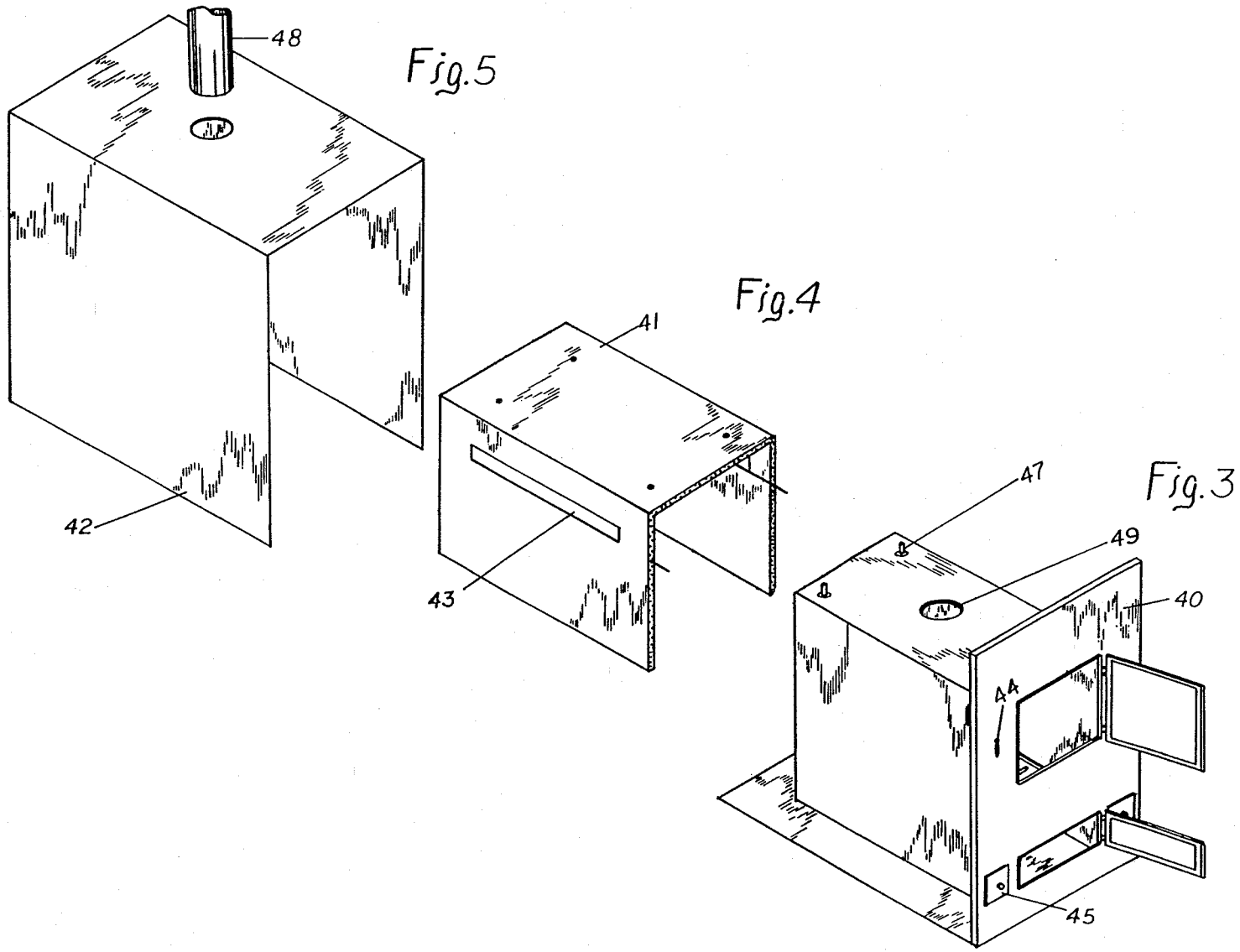
FIG. 3 is a view of the stove firebox prior to installing the apparatus.
FIG. 4 is a view of the apparatus showing how it wraps around said stove firebox exhaust area.
FIG. 5 is a view of the outer cover of the stove, the firebox, and the wrap-around apparatus.
Figure 7:
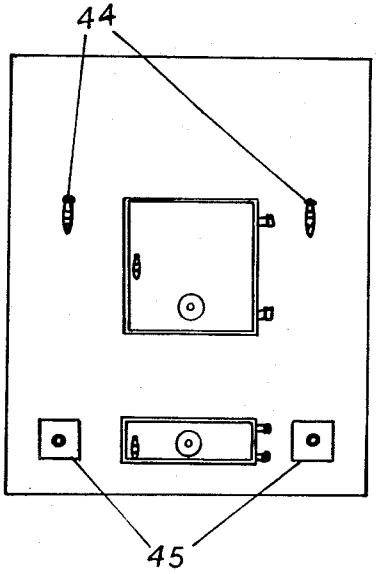
FIG. 7 is a view of the stove front for FIG. 6.
Figure 6:
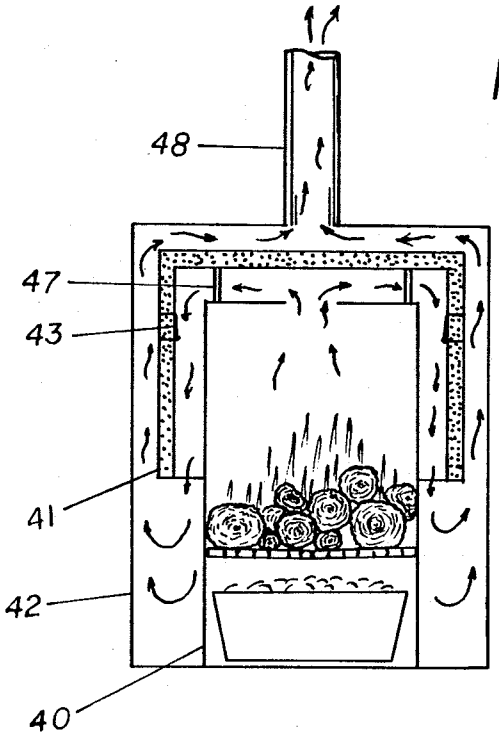
FIG. 6 is a cut-away view of the stove with the wrap-around insulated apparatus and the stove cover with arrows representing the exhaust gases from a wood fire and their flow pattern.

Referring now to FIGS. 1 through 7, there are illustrations showing cut-away views of the apparatus installed on the outside of the firebox of a wood or coal stove. The stove firebox 40, with a front panel containing servicing doors and controls, has an exhaust 49 in or near its top (FIGS. 1, and 3), for its exhaust gases to exit said firebox. The wrap-around, cabinet-type, insulated open base enclosure 41 is held in place by spacers 47 and by being attached to the firebox front panel and is sized to allow air space to exist between its sides and top and the firebox. The insulated enclosure serves as a baffle directing the hot exhaust gases, exiting the firebox, to blanket the entire upper outside portion of said firebox exhaust area in a wrap-around fashion, thus creating and maintaining such high temperatures in said firebox exhaust area that smoke particles are burned before they can exit said area. The insulation of enclosure 41 contributes to maintaining this high temperature and the burning of smoke particles. The cover 42 encases said firebox and its wrap-around enclosure and has a chimney connection in or near its top. As said hot gases pass from under the open base enclosure 41 (FIG. 2 & 6), they are at the bottom of the stove and against the inside of the outside cover 42 of the stove, and as the hot gases rise to the stove exhaust chimney 48, all of the stove cover 42 becomes a hot heat exchanger surface, thereby giving the stove a high efficiency rating for heat extraction. At least one door 43, located in the upper part of the wrap-around enclosure 41, when opened, furnishes a more direct by-pass route to the chimney for the exhaust gases to travel when a fire is first ignited in said stove. As the fire increases and the stove becomes hot, the door 43 should be closed. Handles 44 are used to control door 43. Clean-out doors 45 (FIG. 1 & 7) serve as means of cleaning the enclosed wall area created by the design.

Figure 10:
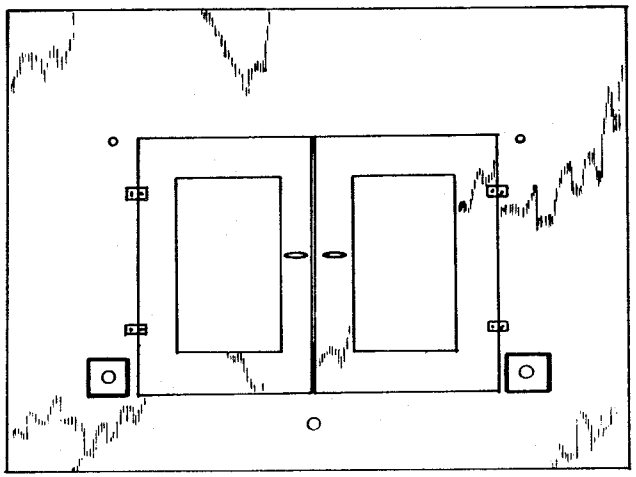
FIG. 10 is a view of the fireplace front for FIG. 8.
Figure 9:
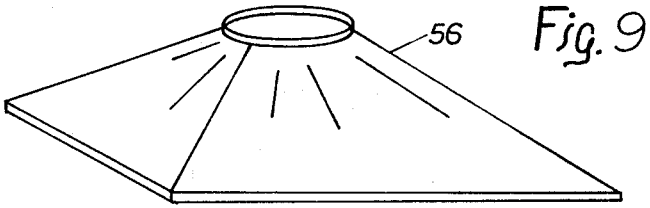
FIG. 9 is a view of the fireplace cover and exhaust.
Figure 8:
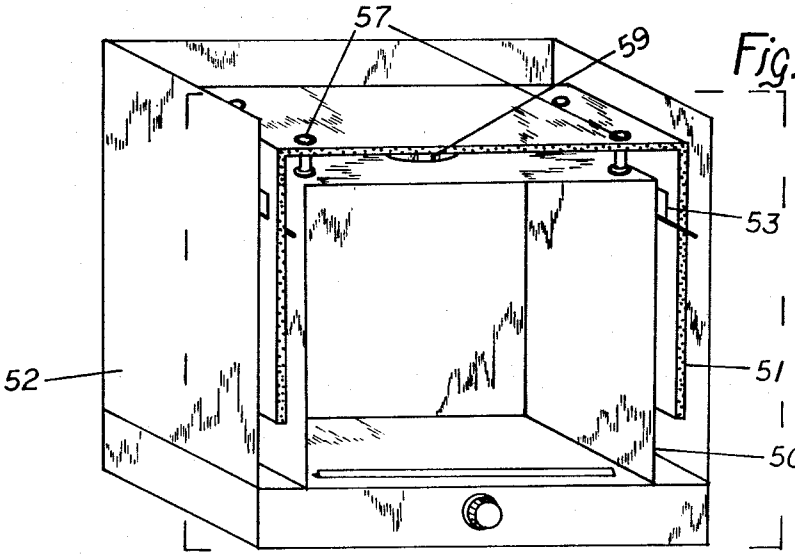
FIG. 8 is a cut-away view of a free-standing fireplace unit showing the relationship of the firebox area and the wrap-around apparatus both positioned inside the fireplace unit.
Figure 12:
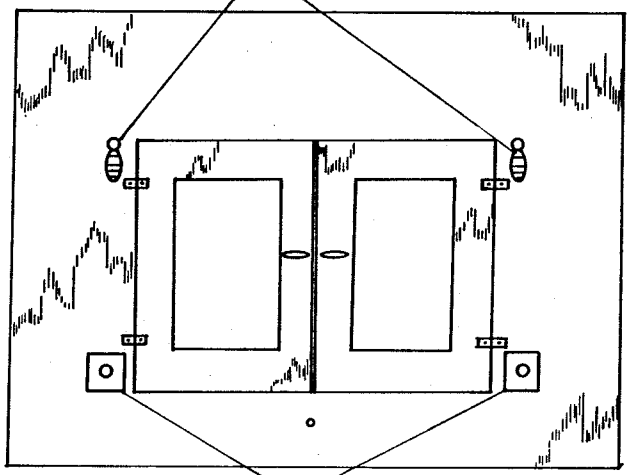
FIG. 12 is a view of the fireplace front for FIG. 11.
Figure 11:
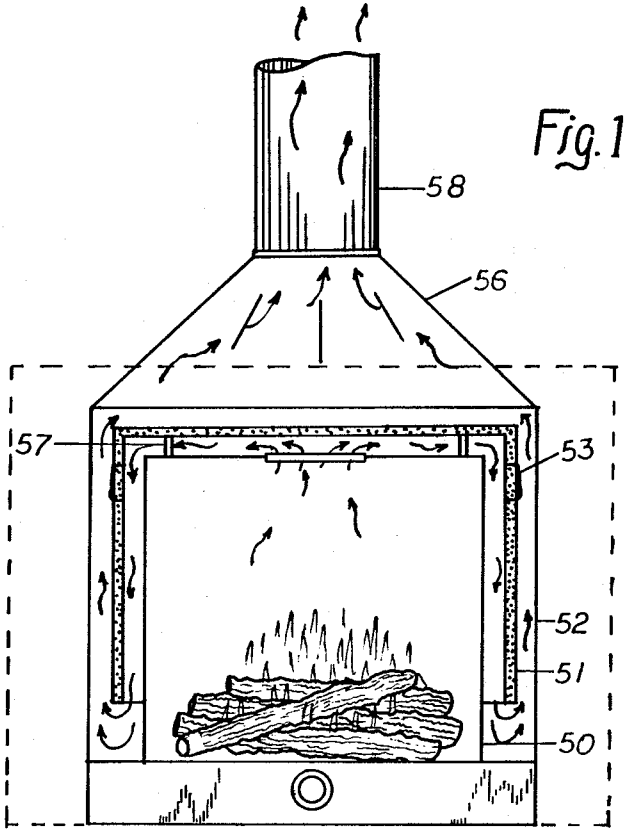
FIG. 11 is a cut-away view of the fireplace containing a wood fire and illustrates with arrows the flow of the exhaust gases.

Referring now to FIGS. 8 through 12, there are illustrations showing various cut-away views of the apparatus installed on the inside of the firebox of a free-standing fireplace. FIG. 8 shows a view of the fireplace liner 50 positioned inside said firebox showing the smoke exhaust 59 in the top center. The wrap-around, cabinet-type, insulated enclosure 51 has an open base and is shown positioned as a cap over firebox 50 and held in place by spacer posts 57. The base and outer walls 52, with the exhaust chimney connector 56 above (FIG. 9) are shown holding firebox 50 with wrap-around enclosure 51 attached, and with each to be connected to the fireplace front (FIG. 10). FIG. 11 shows a cut-away view of the free-standing fireplace with a wood fire burning and illustrates with arrows the flow pattern of the hot exhaust gases as they exit the firebox area 50 and are guided by the wrap-around enclosure 51 to blanket the upper outside of the firebox area, thereby causing high temperatures and the burning of existing smoke particles plus improving the combustion efficiency of the burn. As the hot exhaust gases pass from under the open base enclosure 51, they are at the bottom of the fireplace and against the inside of the outer cover 52 of the fireplace and as said hot gases rise to the fireplace exhaust chimney 58, all of the outside cover of the free-standing fireplace becomes a hot heat exchanger surface, thereby giving said fireplace a high efficiency rating for heat extraction. At least one door 53, located near the upper part of enclosure 51 can be opened by handle 54 (FIG. 12) when needed for draft to serve as a short by-pass route for exhaust gases to reach the chimney when a fire is first ignited in the fireplace. As the fire increases and the fireplace becomes hot, door 53 should be closed. Clean out doors 55 for said area are shown in FIG. 12 on the door panel section of the fireplace.

Figure 15:
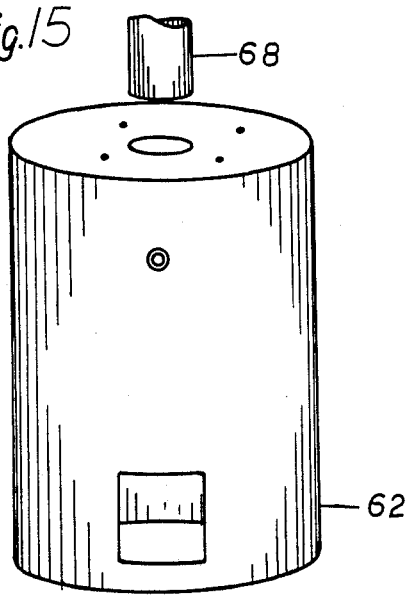
FIG. 15 and 16 are views of the outside cover for said drum stove.
Figure 16:
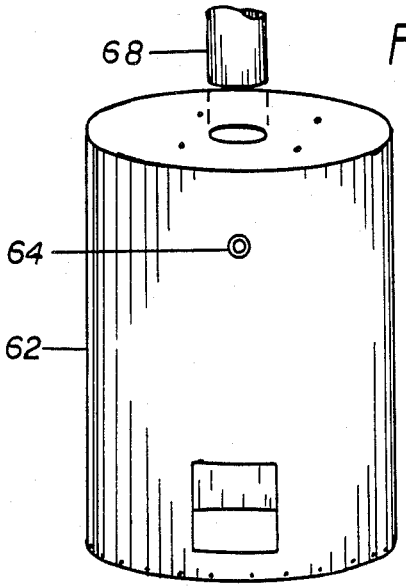
Figure 14:
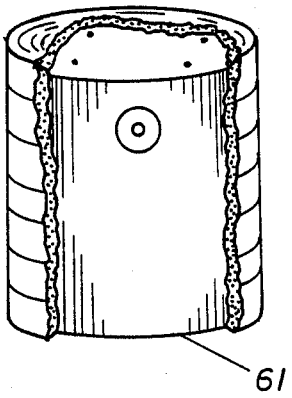
FIG. 14 is a view of the wrap-around insulated apparatus.
Figure 17:
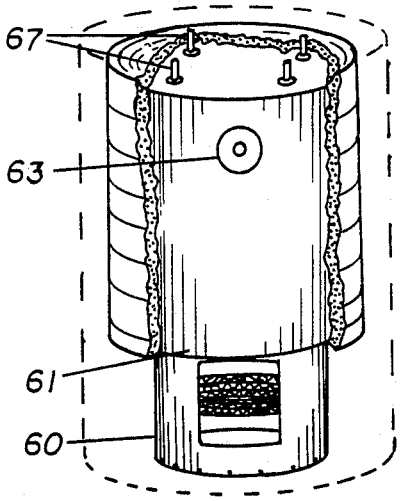
FIG. 17 is a cut-away view of FIG. 13 with FIG. 14 installed.
Figure 18:
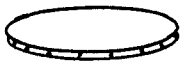
FIG. 18 is a base enclosure for FIG. 17.
Figure 13:
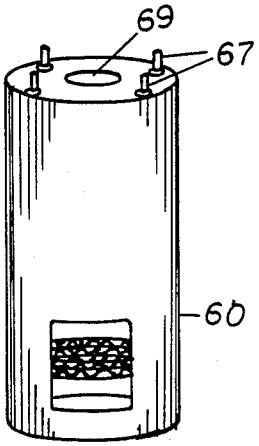
FIG. 13 is a view of a drum used as a stove.
Figure 19:
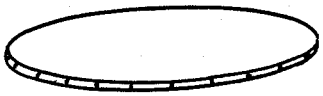
FIG. 19 is a base enclosure for FIG. 16.
Figure 20:
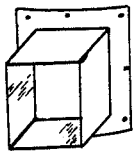
FIG. 20 is a view of the door casing.
Figure 21:
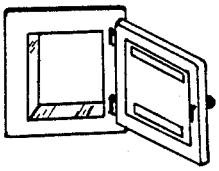
FIG. 21 is a view of the outer door unit.
Figure 23:
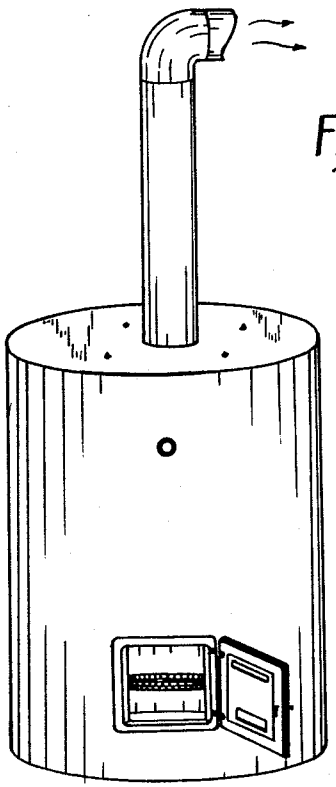
FIG. 23 is an outer view of the drum stove.
Figure 22:
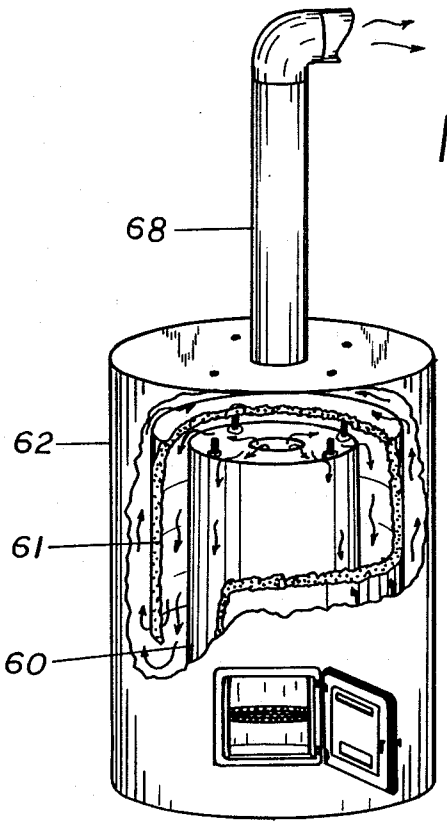
FIG. 22 is a cut-away view of FIGS. 16, 17, 18, 19, 20 and 21 installed together showing the wrap-around features and flow patterns of the exhaust gases.

Referring now to FIGS. 13 through 23, there are illustrations and cut-away views of a drum type stove. FIG. 13 shows an inverted drum 60 containing a grate and has an exhaust 69 in its top center and contains four spacer posts 67. FIG. 14 shows a slightly larger inverted drum 61 that contains a layer of insulation. FIG. 15 shows a still larger inverted drum that contains an exhaust in its top center for chimney pipe 68. FIGS. 16 and 17 illustrates how drums 60, 61 and 62 are telescoped together and held in place by spacer posts 67. FIGS. 18 and 19 show bottom enclosure panels for drums 60 and 62. FIGS. 20 and 21 illustrates the casing and servicing door for the drum stove. FIG. 22 is a cut-away view of the drums and their telescoped positions and illustrates with arrows the flow pattern of the hot exhaust gases as they exit the firebox area located in drum 60, and are directed by the wrap-around insulated enclosure drum 61 to blanket the upper outside of the firebox area 60, thereby causing high temperatures and the burning of existing smoke particles, plus improving the combustion efficiency of the burn. As the hot exhaust gases pass from under the insulated cap drum 61, they are at the inside bottom of drum 62 and as said hot gases rise to the exhaust chimney 68, all of the outside cover of drum 62 becomes a high temperature heat exchanger, thereby becoming a high efficiency heat extractor. The opening of by-pass door 63, shown in FIG. 17 on cap drum 61, serves as a means of increasing draft, when needed. FIG. 23 illustrates the drum stove.

Figure 24:
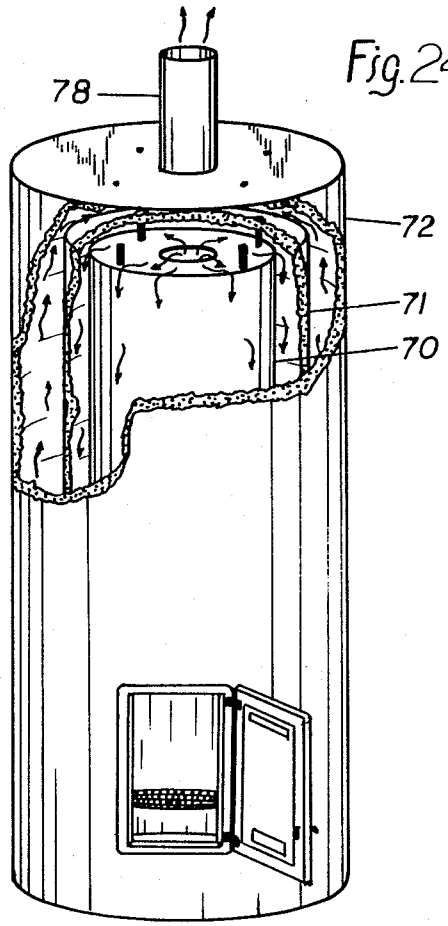
FIG. 24 is a cut-away view of an incinerator showing its insulated wrap-around apparatus and its insulated outside cover.

FIG. 24 illustrates a cut-away view of how the apparatus can be used as an incinerator and how it can be sized to the desired need and shows that the insulation is also applied to the outside cover 72, as a smokeless burn is the only desired achievement.

Figure 25:
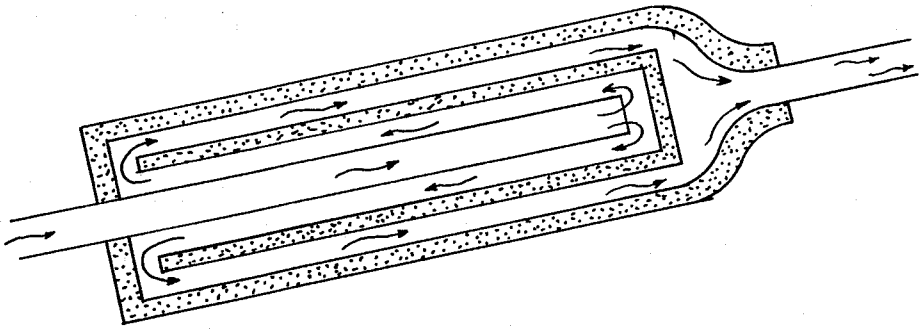
FIG. 25 is a cut-away view of the wrap-around apparatus and its use on an internal-combustion engine exhaust with arrows showing the exhaust flow pattern.
Figure 26:
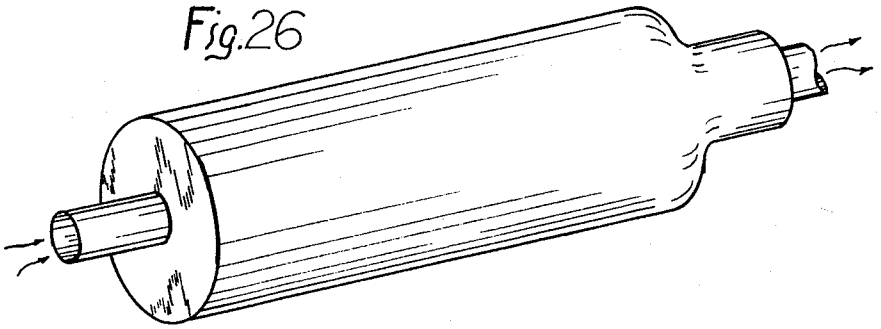
FIG. 26 is an outside view of FIG. 25.

FIG. 25 shows a cut-away view of how this invention could be applied to a smokey exhaust of an internal combustion engine, such as a diesel engine, and illustrates with arrows how the flow of exhaust gases would pass through said apparatus. The apparatus would be attached to the engine exhaust at or near the engine, which, being enclosed in insulation, would hold high temperatures, thus burning smokey particles before they could exhaust from said apparatus. FIG. 26 is an outside view of FIG. 25.

Figure 27:
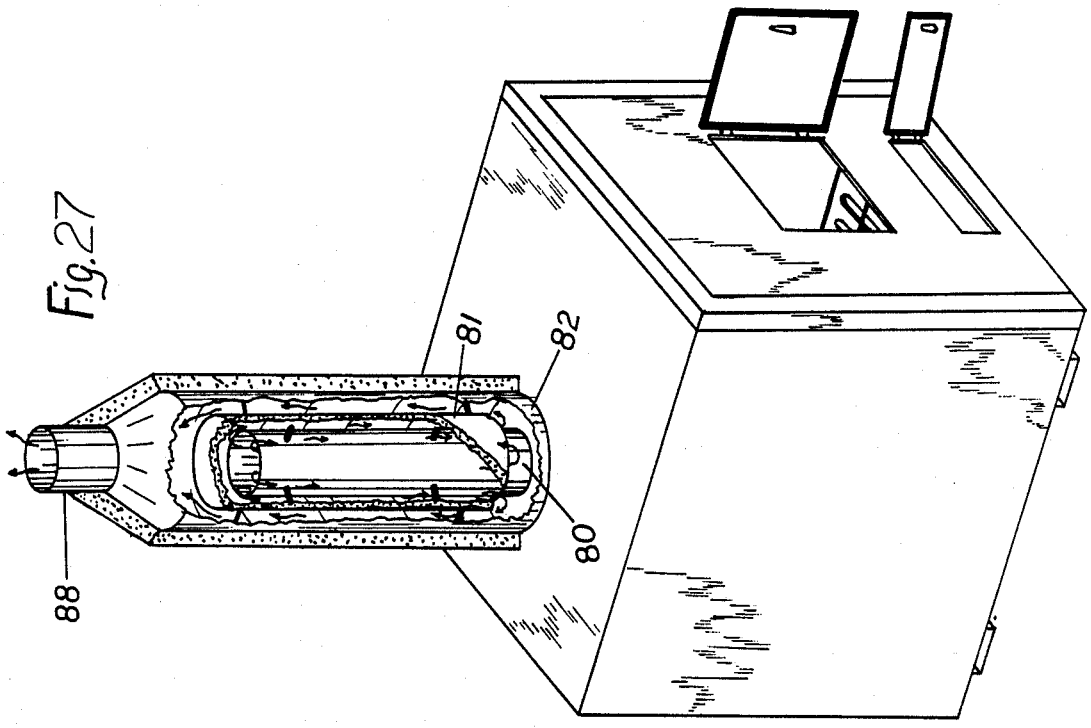
FIG. 27 is a cut-away view of the apparatus attached to the exhaust of a furnace or stove when the only objective is a smokeless burn.

FIG. 27 shows a cut-away illustration of how this invention could be designed as a portable unit and applied to a smokey exhaust of a furnace or stove, where a smokeless burn is the only desired objective. Inner pipe 80 is attached to the furnace or stove exhaust and is telescoped into larger insulated cap pipe 81, which is telescoped into cover pipe 82 with said cover 82 having its top connected to chimney pipe 88 and is surrounded also with a layer of insulation, thus as hot exhaust gases travel through each of the three telescoped pipes, and wraps itself with its own heat, smoke particles are burned before they are exhausted into the chimney.

Figure 29:
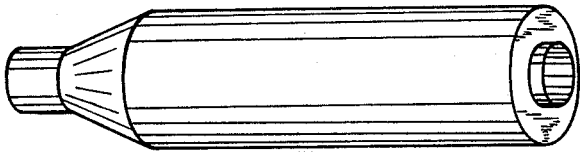
FIG. 29 is an outside view of FIGS. 27 or 28.
Figure 28:
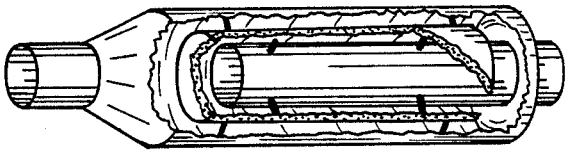
FIG. 28 is a cut-away view of the apparatus used to extract both heat and smoke.

FIG. 28 shows a cut-away illustration of how this invention could be applied to a smokey exhaust of a furnace or stove, where the desire is to extract both heat and smoke. Insulation is only used on the cap pipe 81 which wraps around the exhaust pipe 80 and extracts smoke while cover pipe 82 is not insulated and is used as a heat exchanger, thus extracting heat. FIG. 29 is an outside view of the portable apparatus.

It is to be understood that the foregoing drawings and discription of the invention is to be taken as a preferred embodiment and that various other modifications will occur to those skilled in the art upon reading the disclosure, however all changes and modifications that come within the spirit of the invention are desired to be protected.

I claim:

1. An apparatus for directing the flow of hot exhaust gases from a fuel burn fire in the firebox of a stove, fireplace, insert or furnace to wraparound and blanket selected areas of the outer surface of said firebox, and then conveying same into a chimney area, and extracting heat and smoke, comprising a. a firebox having an attached base, a front panel containing servicing doors and controls, an exhaust area proximate its top, and at least one post proximate its outside top, for support and spacing, b. an insulated, open base, cabinet type enclosure capped over the firebox exhaust area and supported by the support posts and being sufficient in size to allow allotted air space to exist between its inside walls and top and the outside walls and top of said firebox, and sufficient in height to allow allotted air space to exist at its open base, c. an outer cover over said firebox and its open base, insulated capping enclosure with said cover attached to the front panel and base of said firebox, said outer cover having chimney connections in its top area forming a chimney area, said outer cover being of sufficient size to allow allotted air space to exist between its inside walls and top and the outside walls and top of the insulated capping enclosure, thus forming a passageway for the hot exhaust gases to pass from the fire into the chimney area.

2. The apparatus in claim 1, and further comprising a draft door located in the upper area of the insulated capping enclosure with means of control, so that when opened improves draft.

3. The apparatus in claim 1, and further comprising the attachment of the insulated, open base, capping enclosure to the front panel that contains servicing doors and controls.

4. The apparatus in claim 3, and further comprising a draft door located in the upper area of the insulated capping enclosure with means of control, so that when opened improves draft.

5. A method of directing the flow of hot exhaust gases from a fuel burn fire in the firebox of a stove, fireplace, insert or furnace to wrap-around and blanket selected areas of the outer surface of said firebox, and then conveying same into a chimney area, and extracting heat and smoke, comprising the steps of a. having a firebox with an attached base, a front panel containing servicing doors and controls, an exhaust area proximate its top, and at least one post installed proximate its outside top for support and spacing, b. capping the firebox exhaust area with an insulated, open base, cabinet type enclosure supported by the support posts and being sufficient in size to allow allotted air space to exist between its inside walls and top and the outside walls and top of said firebox, and sufficient in height to allow allotted air space to exist at its open base, c. positioning an outer cover over said firebox and its open base, insulated, capping enclosure and attaching same to the front panel and base of said firebox, said outer cover having chimney connections in its top area forming a chimney area, said outer cover being sufficient in size to allow allotted air space to exist between its inside walls and top and the outside walls and top of the insulated capping enclosure, thus forming a passageway for the hot exhaust gases to pass from the fire into the chimney area.

6. The method in claim 5 and further comprising the step of installing a draft door, or doors, in the upper area of the insulated capping enclosure with means of control so that when opened, improves draft.

7. The method in claim 5 and further comprising the step of attaching the insulated, open base, capping enclosure to the front panel that contains servicing doors and controls.

8. The method in claim 7 and further comprising the step of installing a draft door, or doors, in the upper area of the insulated capping enclosure with means of control so that when opened, improves draft.

* * * * *